US005214946A

United States Patent [19]

Antonello

[11] Patent Number: 5,214,946

[45] Date of Patent: Jun. 1, 1993

[54] MULTI-CONTROLLED SECURITY LOCK

[76] Inventor: Luis M. Antonello, Viale XXI Aprile, 12, Roma, Italy, I-00162

[21] Appl. No.: 613,829

[22] PCT Filed: Jul. 11, 1989

[86] PCT No.: PCT/IT89/00049

§ 371 Date: Feb. 7, 1991

§ 102(e) Date: Feb. 7, 1991

[87] PCT Pub. No.: WO90/00659

PCT Pub. Date: Jan. 25, 1990

[30] Foreign Application Priority Data

Jul. 11, 1988 [IT] Italy ..... 48174 A/88

[51] Int. Cl.[5] ..... E05B 47/00

[52] U.S. Cl. ..... 70/279; 70/416; 292/144; 292/153; 292/160; 292/168; 292/DIG. 65

[58] Field of Search ..... 70/1.5, 1.7, 279, 416; 292/144, 153, 158, 160, 168, DIG. 65, 346

[56] References Cited

U.S. PATENT DOCUMENTS

| | | | |
|---|---|---|---|
| 1,896,203 | 2/1933 | Rosatelli | 292/158 X |
| 3,141,319 | 7/1964 | Schlage | 70/462 |
| 3,432,631 | 3/1969 | Deutscher et al. . | |
| 3,510,161 | 5/1970 | Wilson | 292/153 X |
| 3,603,630 | 9/1971 | Check | 292/346 X |
| 3,740,978 | 6/1973 | Smith et al. | 70/203 X |
| 3,892,110 | 7/1975 | Poli | 292/173 X |
| 4,301,667 | 11/1981 | Best et al. | 70/380 |
| 4,372,419 | 2/1983 | Barnett et al. | 292/144 X |
| 4,772,055 | 9/1988 | Fang | 292/167 X |
| 4,815,774 | 3/1989 | Correnti | 292/145 |
| 4,848,118 | 7/1989 | Tesone | 292/346 X |

FOREIGN PATENT DOCUMENTS

| | | | |
|---|---|---|---|
| 0389728 | 10/1990 | European Pat. Off. | 70/279 |
| 389733 | 2/1924 | Fed. Rep. of Germany | 292/144 |
| 2504774 | 8/1975 | Fed. Rep. of Germany | 292/144 |
| 2536108 | 5/1984 | France | 292/144 |

*Primary Examiner*—Lloyd A. Gall

*Attorney, Agent, or Firm*—Cohen, Pontani, Lieberman, Pavane

[57] ABSTRACT

A multi-controlled security lock includes a slide which can be moved back and forth with respect to frame by at least one of two control devices, such as, a key control device or a remote electric control device. A carriage mounted on lock bolts is movable back and forth with respect to the frame. An irreversible actuating device is located between the carriage and the slide for permitting a movement of the carriage between an open position and a locked position in response to a movement of the slide and for preventing a movement of the carriage between the locked position and the open position in response to a force exerted on the carriage.

5 Claims, 2 Drawing Sheets

MULTI-CONTROLLED SECURITY LOCK

BACKGROUND OF THE INVENTION

The present invention, relates to a multi-controlled security lock designed in particular for use as a part of a security system installed for the protection of enclosed areas and capable of being operated locally by a key and remotely by electrical control.

DESCRIPTION OF THE PRIOR ART

Prior art multi-controlled locks of this type are generally provided with a latch element that can be moved back and forth by use of either a key or an electric control device typically a power solenoid.

Prior art security locks, however, have several disadvantages, the main disadvantage being the large number of component parts resulting in costly manufacture and poor reliability.

A further disadvantage of prior art security locks is that they are manufactured in different versions each meeting specific application requirements such as, for instance a right-hand version or a lefthand version for installation on right hinged or left hinged doors, respectively, and outside and inside according to whether the security lock is to be installed on the outer or inner face of the door to be protected, and the like.

A still further disadvantage of prior art security locks is that they cannot generally be operated by means of a panic handle from inside the area to be protected in order to permit a fast emergency exit.

SUMMARY OF THE INVENTION

It is an object of the present invention to provide an improved more reliable security lock of low cost design having a lower number of component parts used in the constructions and being easily manufacturable.

It is another object of the present invention to provide a perfectly symmetrical or universal security lock such that one model thereof can be used in every kind of application as both a left-hand and right-hand lock, mounted on either the door wing or the door frame.

It is a further object of the present invention to provide a security lock which can be easily fitted with a panic handle to facilitate exit from the protected area under emergency conditions.

According to the present invention there is provided a multi-controlled security lock including a slide which can be moved back and forth with respect to the frame by at least one of two control devices, such as a key control device or a remote electric control device; a carriage, constrained by lock bolts, being movable back and forth with respect to the frame; and a non-reversible actuating device located between the slide and the carriage, the arrangement being such that the back and forth movement of the slide causes, through the non-reversible device, the back and forth movement of the carriage, however, a force exerted on the carriage, at least in the lock opening direction, causes the carriage to be locked in position.

A panic device driving the slide is also provided.

A security lock constructed according to the present invention will, therefore, feature high security, both active and passive, as well as simplicity and low cost due to the lower number of component parts.

BRIEF DESCRIPTION OF THE DRAWINGS

A preferred embodiment of a multi-controlled security lock constructed according to the present invention will now be described in more detail by way of example, with reference to the accompanying drawings, in which.

DETAILED DESCRIPTION OF THE PREFERRED EMBODIMENT

Figure 1:
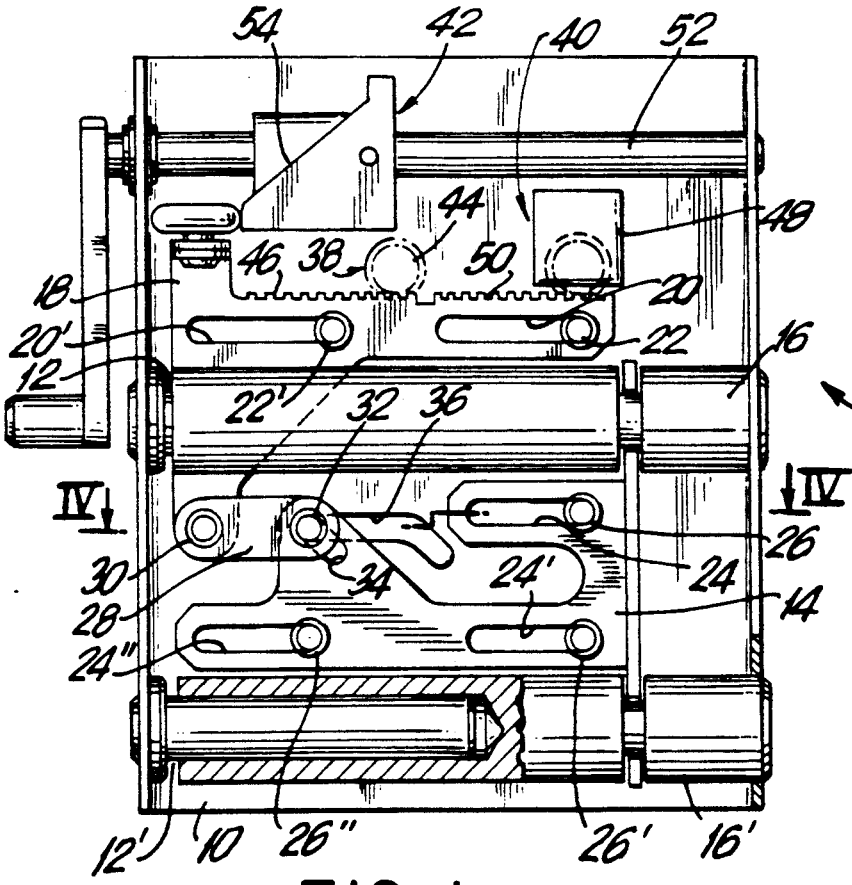
FIG. 1 is a side view, partially in section, of a preferred embodiment of the lock when the lock bolt is in a retracted or inoperative position.
Figure 3:
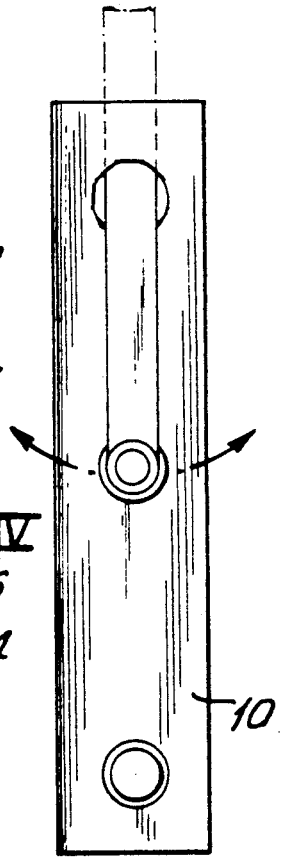
FIG. 3 is a front view of the lock of FIG. 1.
Figure 4:
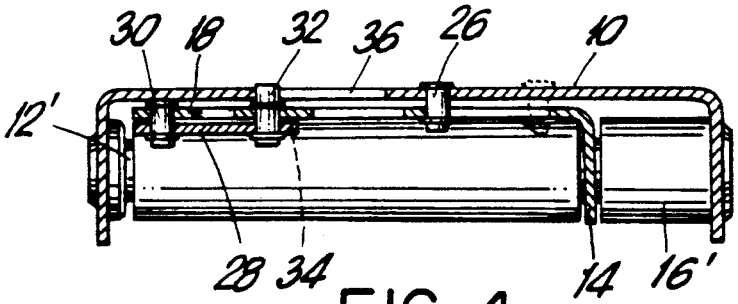
FIG. 4 is a top view of the lock of FIG. 1.

Referring to the accompanying drawings and in particular to FIG. 1, the security lock comprises a box frame 10 to which two guides 12, 12' are secured. Sliding along the guides 12, 12' are two lock bolts 16, 16' which engage the door frame, in known manner.

Figure 2:
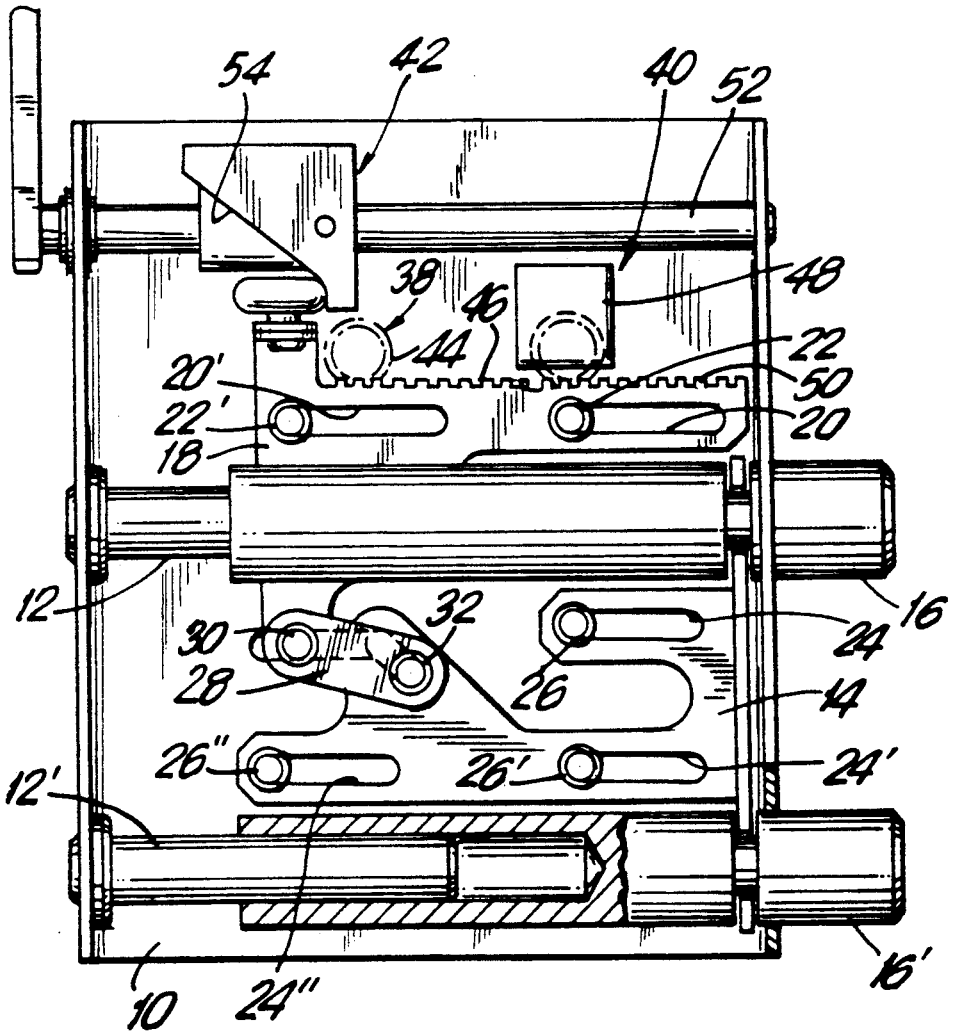
FIG. 2 is a side view, partially in section, of the lock of FIG. 1 when the lock bolt is in an extended or operative position.

Lock bolts 16, 16' constrain a carriage 14 which can move back and forth from a retracted or inoperative position inside the security lock box frame 10, as shown in FIG. 1, to an extended or operative locking position, as shown in FIG. 2, wherein lock bolts 16, 16' extend from the box frame 10.

The back and forth movement of a carriage 14 is actuated by a slide 18 consisting of a plate provided with two slots 20, 20', which is guided by two pins 22, 22' fixed to frame 10. The movement of slide 18 on frame 10 is thus guided by the two slots 20, 20' located on slide 18 along which the two pins 22, 22' fixed to frame 10 slide.

Three slots 24, 24' 24'' along which pins 26, 26', 26'' slide, respectively, are provided on the carriage 14 to permit an axial back and forth movement of the carriage 14 relative to the frame 10. A side bar 28 is pivoted at one end on the pin 30 which is fixed to the slide 18, and at the other end on a pin 32 sliding along two superposed slots, one slot 34 being machined in the carriage 14 and the other slot 36 being machined in the frame 10.

Since the end portion of the slot 36 located on frame 10, and that of the slot 34 located on the carriage 14 are both included at approximately 45-degree with respect to the carriage 14 in the direction of movement, when the pin 32 reaches the inclined end portion of the slot 36 located on the frame 10, the carriage 14 will advance by a shorter distance than slide 18 does because of the slanted path through which it travels and the side bar 28 will then be driven into an oblique position and will eventually be set to the maximum slant angle when the carriage 14 reaches the operative position, as better shown in FIG. 2.

The side bar 28 at the maximum short angle ensues that the carriage 14 cannot be moved away from the operative or locked position since any force exerted upon it with the purpose of unlocking it, would also act upon the slide 18 through the side bar 28. Since, however, the side bar 28 is substantially included, such a force applied to the carriage 14 will tend to cause the side bar 28 to rotate further, whereas the constraint formed by the slot 36 located on the frame 10 will tend to make it rotate in the reverse direction.

Thus, the pin 32 will be clutched between the slot 36 located on the frame 10 and the slot 34 located on the carriage 14, and thus the carriage 14 can no longer be moved unless by direct action from the slide 18 through the side bar 28.

To move the carriage 14 back to the inoperative or unlocked position, the slide 18 must be moved to a leftward position, as viewed in FIG. 2, drawing along the side bar 28 through the pin 30 thereof, thus forcing the pin 32 to travel through the oblique portion of the slot 36 located on the frame 10 and of the slot 34 located on the carriage 14, eventually moving the carriage 14 backwards into the security lock body.

Slide 18 is actuated by three control devices, namely a manual control device 38, a remote control device 40, and a panic control device 42.

The manual control device 38 consists of a conventional key-operated cylinder whose rotary motion is transmitted to the slide 18 through a gear train whose final gear 44 has one tooth less. Gear 44 co-operates with a rack 46 which is constructed so that when the key control device 38 is at either end position thereof, the slide 18 and the the cylinder will disengage from each other thus allowing the other control devices to be used.

The remote control device 40 includes an electric motor 48 which drives a rack 50 through a reversible reduction gear train.

The panic control device 42 includes a shaft 52 which is rotated by a panic handle attached thereto in any desired manner. The shaft 52 pushes a double circular cam 54 located on the shaft 52 into bidirectional rotary motion. The double circular cam 54 has a cam surface which forces the slide 18 towards the retracted position when shaft 52 is rotated in either direction.

It is obvious that other numerous and different alterations and modifications can be adopted by those skilled in the art, of the embodiments of the present invention hereinbefore described, without departing from its scope. It is, therefore, intended that all these changes and modifications are encompassed in the field of this invention. The foregoing description of the preferred embodiments is thus by way of example and not limitation of the present invention.

What is claimed is:

1. A multi-controlled security lock comprising:

a frame;

at least two actuating devices;

a movable slide having a first position and a second position, different from said first position with respect to said frame, being movable from said first position to said second position by each of said two actuating devices and being movable between said first position and said second position by at least one of said actuating devices;

a carriage having an axis of movement, an open position and a locked position with respect to said frame;

a lock bolt on said carriage and having a predetermined relation thereto; and an irreversible actuating device located between said carriage and said slide, for permitting a movement of said carriage between said open position and said locked position in response to a movement of said slide and for preventing a movement of said carriage between said locked position and said open position in response to a force exerted on said carriage, comprising a pin fixably mounted to said slide, and a side bar having a first end and a second end, said first end being pivotably mounted on said pin, a first slot formed obliquely to said axis of movement on said carriage and a second slot being formed on said frame having an initial horizontal portion and a final portion which is inclined with respect to said axis of movement, said first and second slots being superimposed.

2. The security lock according to claim 1, wherein said lock bolt has an axis of movement and a channel penetrating said bolt, said security lock further comprising the guide being disposed in said channel and guiding said bolt along said axis of movement.

3. The security lock according to claim 1, for use on a side hinged door having a right side and a left side and a wing and a door frame, wherein said lock is operable if mounted on any of the right or the left side or on the wing or the door frame.

4. The security lock according to claim 1, further comprising a panic device transmitting a driving force to said movable slide for movement from said second position to said first position.

5. The security lock according to claim 4, wherein said panic device comprises a shaft and a bidirectionally rotatable cam having a cam surface, on said shaft, said slide further comprising a cam follower contacting said cam surface, such that a rotation of said cam in either direction applies a force to said slide causing movement of said slide towards a predetermined one of said first position and said second position.

* * * * *